US010811831B1

(12) United States Patent
Wu et al.

(10) Patent No.: US 10,811,831 B1
(45) Date of Patent: Oct. 20, 2020

(54) NETWORK CONNECTOR STRUCTURE

(71) Applicants: LIVEWIRE ASIA PACIFIC CO., LTD., Taipei (TW); SIMPLY45 LLC, Dania Beach, FL (US)

(72) Inventors: Chung Tser Wu, Taipei (TW); Andrew Restivo, Dania Beach, FL (US)

(73) Assignees: LIVEWARE ASIA PACIFIC CO., LTD., Taipei (TW); SIMPLY45 LLC, Dania Beach, FL (US)

( * ) Notice: Subject to any disclaimer, the term of this patent is extended or adjusted under 35 U.S.C. 154(b) by 0 days.

(21) Appl. No.: 16/561,120

(22) Filed: Sep. 5, 2019

(51) Int. Cl.
*H01R 24/64* (2011.01)
*H01R 13/03* (2006.01)
*H01R 13/66* (2006.01)

(52) U.S. Cl.
CPC ..... *H01R 24/64* (2013.01); *H01R 13/03* (2013.01); *H01R 13/6691* (2013.01); *H01R 2201/04* (2013.01)

(58) Field of Classification Search
CPC ..... H01R 13/5213; H01R 13/6691; H01R 13/03; H01R 24/64; H01R 2201/04
See application file for complete search history.

(56) References Cited

U.S. PATENT DOCUMENTS 2,641,627 A * 6/1953 Lewis ..... H01R 13/447 174/67
2,987,909 A * 6/1961 Shlank ..... H02G 3/14 70/168
5,549,486 A * 8/1996 Cavallaro ..... H01R 13/639 439/500
6,017,237 A * 1/2000 Sullivan ..... H01R 43/01 439/392
6,102,722 A * 8/2000 Arnett ..... H01R 13/6466 439/189
6,932,641 B1 * 8/2005 Liao ..... H01R 13/508 439/418
7,048,572 B1 * 5/2006 Ting ..... H01R 4/2404 439/418
7,445,483 B2 * 11/2008 Jee ..... H01R 24/64 439/344
8,388,386 B2 * 3/2013 Petersen ..... H01R 43/20 439/620.22
9,134,484 B2 * 9/2015 Wu ..... G02B 6/3821
9,395,498 B2 * 7/2016 Lin ..... G02B 6/32
9,720,181 B2 * 8/2017 Little ..... G02B 6/3817
9,804,342 B2 * 10/2017 Little ..... G02B 6/3855
(Continued)

*Primary Examiner* — Briggitte R. Hammond
(74) *Attorney, Agent, or Firm* — Thomas | Horstemeyer LLP

(57) ABSTRACT

The present invention is a network connector structure, which includes a signal terminal body and a cover plate. Arranged core holes are set on an upper side of an end of the signal terminal body, two holes are respectively set on two sides of the end of the signal terminal body, two convexes are set on the back side of the cover plate, the two convexes on the back side of the cover plate are respectively corresponded to the two holes set on the two sides of the end of the signal terminal body, so that each convex is provided to be embedded into the corresponding hole, and the core holes set on the upper side of the end of the signal terminal body is covered by the back side of the cover plate.

8 Claims, 6 Drawing Sheets

(56) References Cited

U.S. PATENT DOCUMENTS

| | | | | |
|---|---|---|---|---|
| 2009/0124136 | A1* | 5/2009 | Pepe | H01R 4/242<br>439/676 |
| 2011/0243505 | A1* | 10/2011 | Su | H01R 31/06<br>385/75 |
| 2012/0129405 | A1* | 5/2012 | Keshet | H01R 24/78<br>439/676 |

* cited by examiner

NETWORK CONNECTOR STRUCTURE

BACKGROUND OF THE INVENTION

1. Field of the Invention

The invention relates to a network connector structure and, more particularly, to a network connector structure for network connectors or similar products to protecting signal terminal effectively.

2. Description of Related Art

With development of high technology, people are increasingly dependent on the internet for anything, many products or equipments have the ability to connect to the internet for conveniently obtaining information from the internet.

In the conventional network equipments, network sockets are provided for network connectors, wherein, in most of the network connectors, a multi-core guide slot is set on the end edge, twisted pairs in the network cable are pulled out, inserted into the back end of the network connector and respectively embedded into the multi-core guide slot, so that the network connector is provided to connect to the network socket, signals can be transmitted to the network socket through the twisted pairs in the network cable and transmitted to network devices through the network socket.

However, when making the above network connector, twisted pairs in the network cable are needed to be separated outside first, arranged according to rules and positioned in the multi-core slot of the network connector, Since the twisted pairs are mostly curved without fixed direction, actually, it is difficult to aim the twisted pairs when they are inserted into the multi-core slot, or it is impossible to align the twisted pairs in the multi-core slot respectively and one or two of the twisted pairs are not connected to the multi-core slot. Thus, the quality of the network connection is very unstable and should be tested in multiple ways, and the construction time is extended. Also, the material of the network connector is quite fragile, and it may be damaged if not careful.

Therefore, in view of the above drawbacks, the inventor discloses a network connector structure, which is easy to manufacture and can achieve the purpose of protection, and users can easily complete the operation and installation. The inventor is dedicated to research and design to provide user convenience.

SUMMARY OF THE INVENTION

The object of the invention is to provide a network connector structure, which includes a signal terminal body and a cover plate, arranged core holes are set on the upper side of an end of the signal terminal body, two holes are respectively set on two sides of the end of the signal terminal body, two convexes are set on the back side of the cover plate, the two convexes set on the back side of the cover plate are corresponded to the holes set on the two sides of the end of the signal terminal body, so the convexes can be embedded into the holes respectively that the back side of the cover plate is covered the core holes set on the upper side of the end of the signal terminal body. Therefore, when the wires exposed from the core holes, the cover plate is provided to form a barrier to prevent the wires from being touched, to thereby avoid leakage or malfunction. The present invention is provided to protect the signal terminal body and the overall usability is increased.

Another object of the invention is to provide a network connector structure, a concave is set on the back side of the cover plate, the concave is provided to place the wires exposed from the core holes to prevent the wires from being compressed by the cover plate, wherein the concave is any of a rectangular shape or a square shape, the concave can be designed as different shapes according to the arrangement of the core holes, to thereby increase overall usability.

The other object of the invention is to provide a network connector structure, the convexes set on the back side of the cover plate are cylinders, a disc is set on top of each cylinder, the periphery of the discs is larger than the periphery of the cylinders, the discs are conical, so that the discs set on the top of the cylinders are provided to be embedded into the holes when the convexes are embedded into the holes set on the end of the signal terminal body, to prevent the cover plate from being dropped out, to thereby increase overall protection.

In order to further understand the characteristics, features and technology, please refer to the following detailed description and drawings of the present invention, the drawings are provided for reference and description only, not be intended to limit the present invention.

DETAILED DESCRIPTION OF THE INVENTION

Please refer to FIG. 1 to FIG. 6, which are the schematic diagrams of 2

Figure 1:
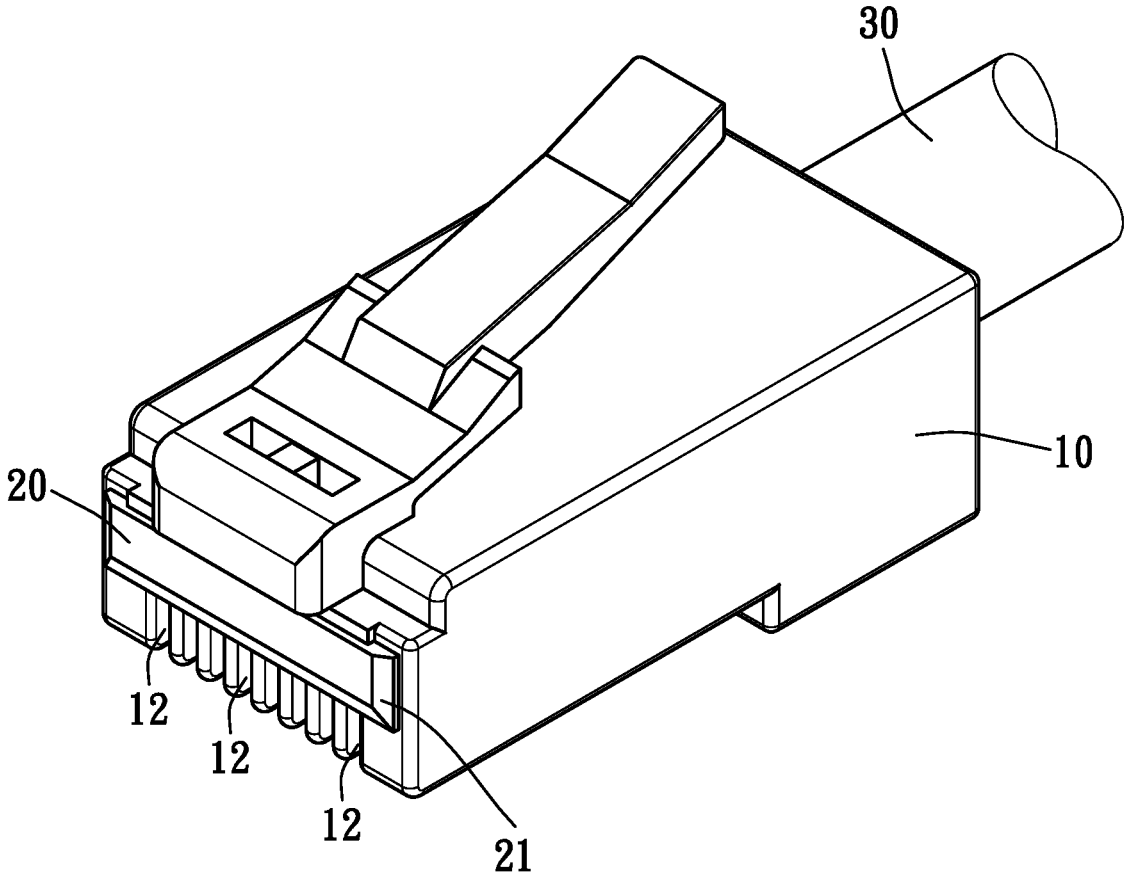
FIG. 1 is a schematic diagram of appearance of the present invention.

The network connector structure of the present invention, including a signal terminal body 10 and a cover plate 20, the signal terminal body 10 is hollow, and the back end of the signal terminal body 10 is an opening, so that a network cable 30 can be passed through the opening on the back end of the signal terminal body 10 (as shown in FIG. 1), and multiple wires 31 are covered in the network cable 30.

Figure 2:
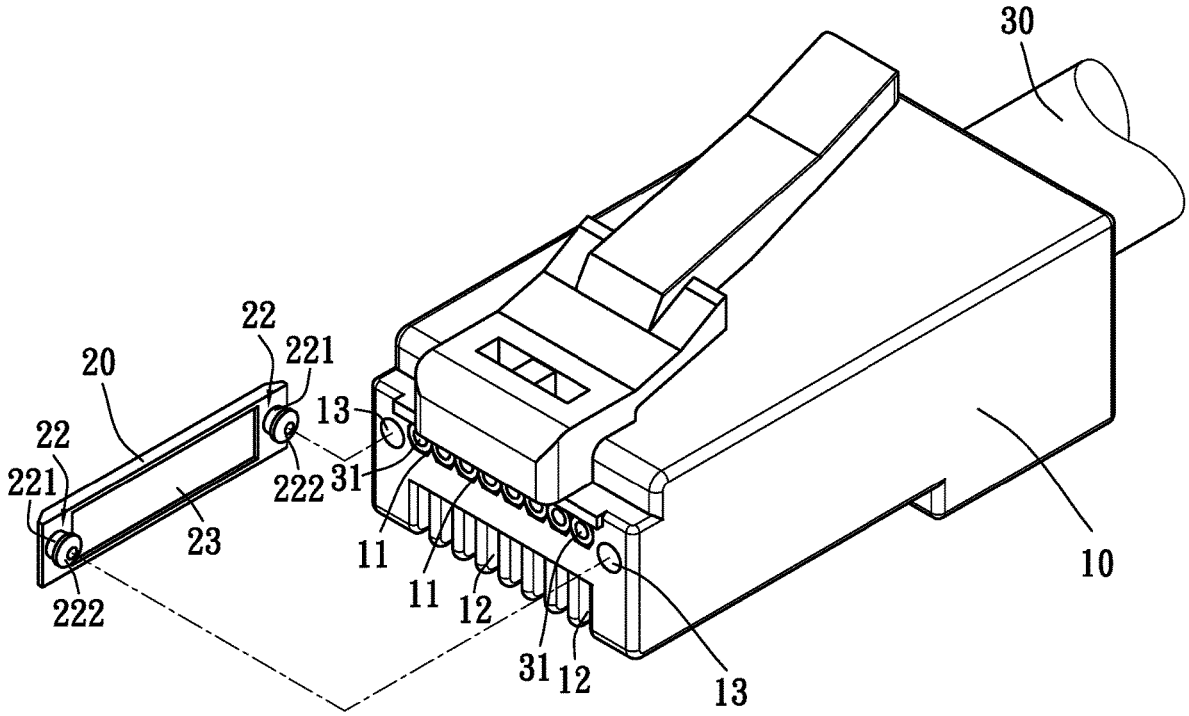
FIG. 2 is an exploded diagram of the present invention.
Figure 5:
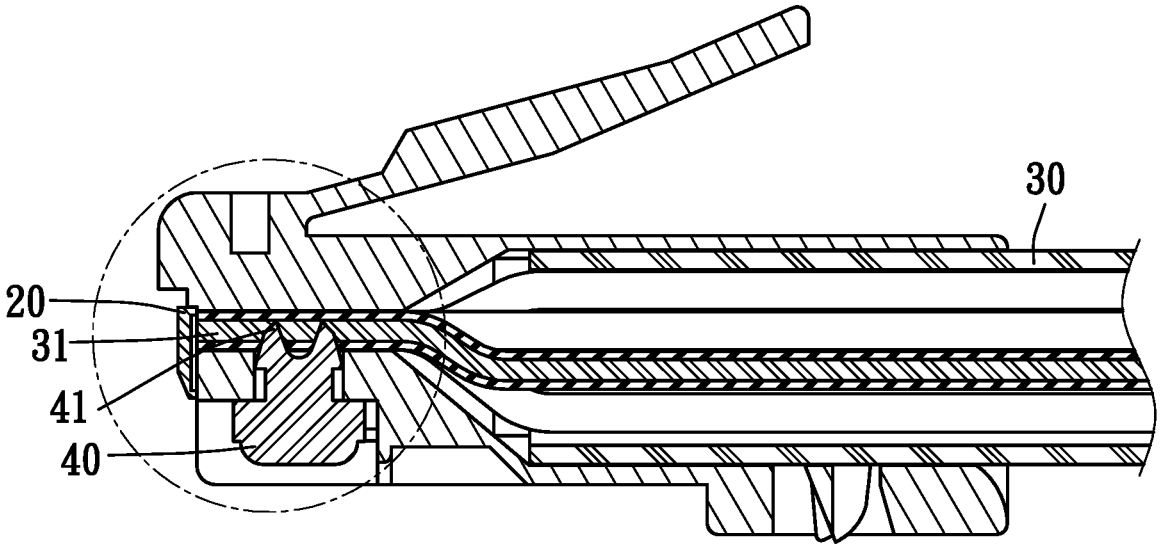
FIG. 5 is a cross-sectional schematic diagram of the present invention.
Figure 6:
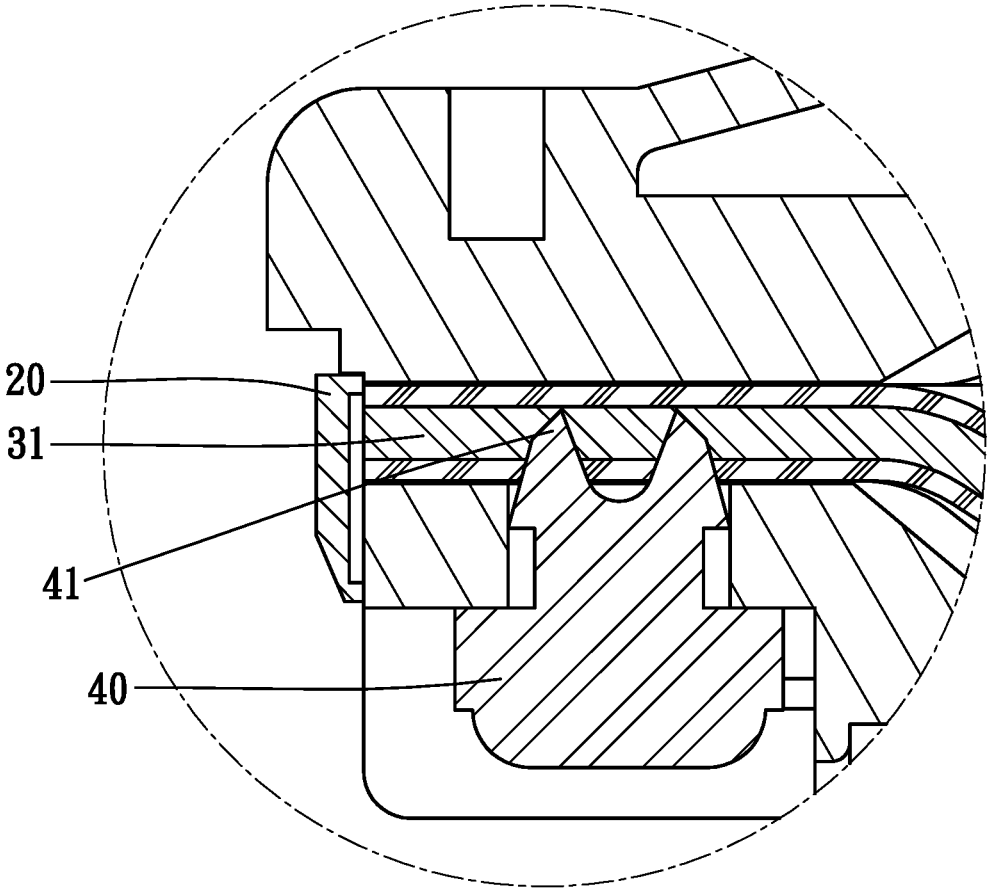
FIG. 6 is an enlarged cross-sectional schematic diagram of the present invention.

Multiple arranged core holes 11 set on the top side of one end of the signal terminal body 10 are provided for the wires 31 covered in the network cable 30 to pass through (as shown in FIG. 2). A wire cutter is used to cut the wires together, so that the wires 31 are neat. Multiple arranged slots 12 are set on the lower side of an end of the signal terminal body 10, a metal piece 40 is set in the slots 12 of the signal terminal body 10, multiple tips 41 are set on an end of the metal piece 40 (as shown in FIG. 5 and FIG. 6), the tips 41 are provided to pierce the wires 31 passed through the upper side of the end of the signal terminal body 10, so that the metal piece 40 is electrically connected to the wires 31 to transmit signals or power.

Two holes 13 are respectively set on two sides of one end of the signal terminal body 10, the holes 13 are located near the core holes 11 (as shown in FIG. 2), wherein the distance between the two holes 13 is larger than the arranged core holes 11, the holes 13 are respectively located on the two sides of the arranged core holes 11.

Figure 3:
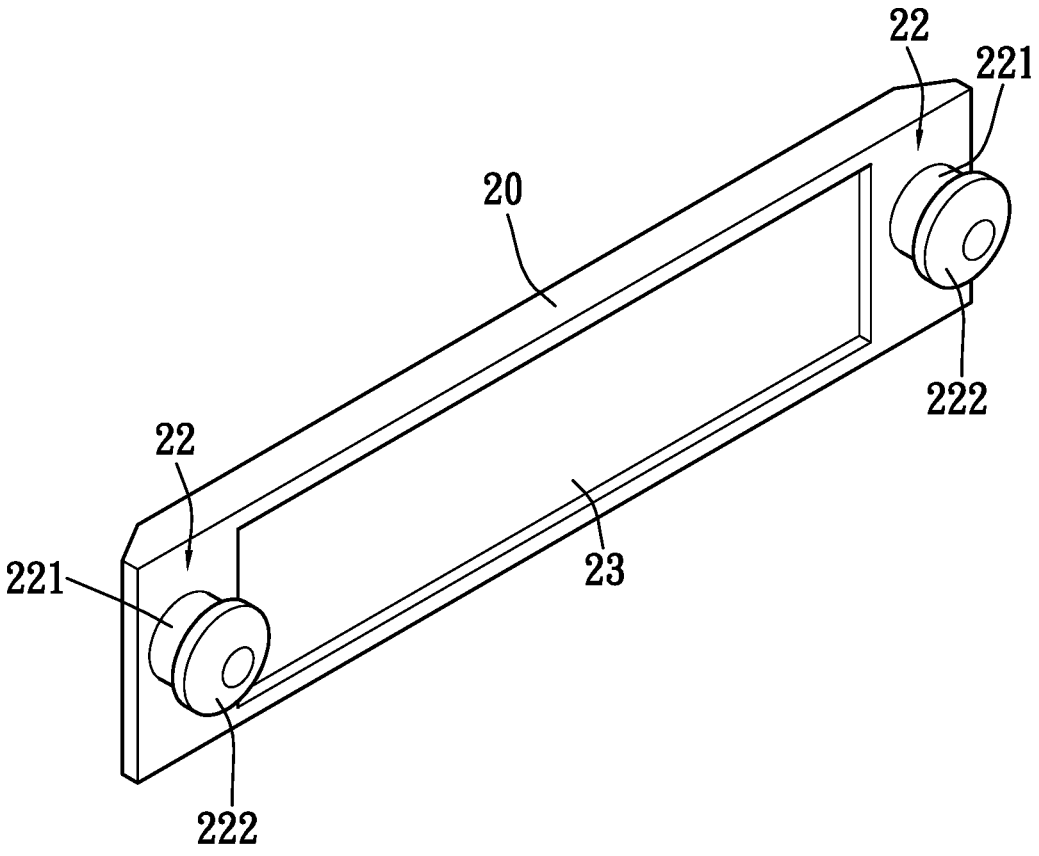
FIG. 3 is a schematic diagram of the back side of the cover plate of the present invention.
Figure 4:
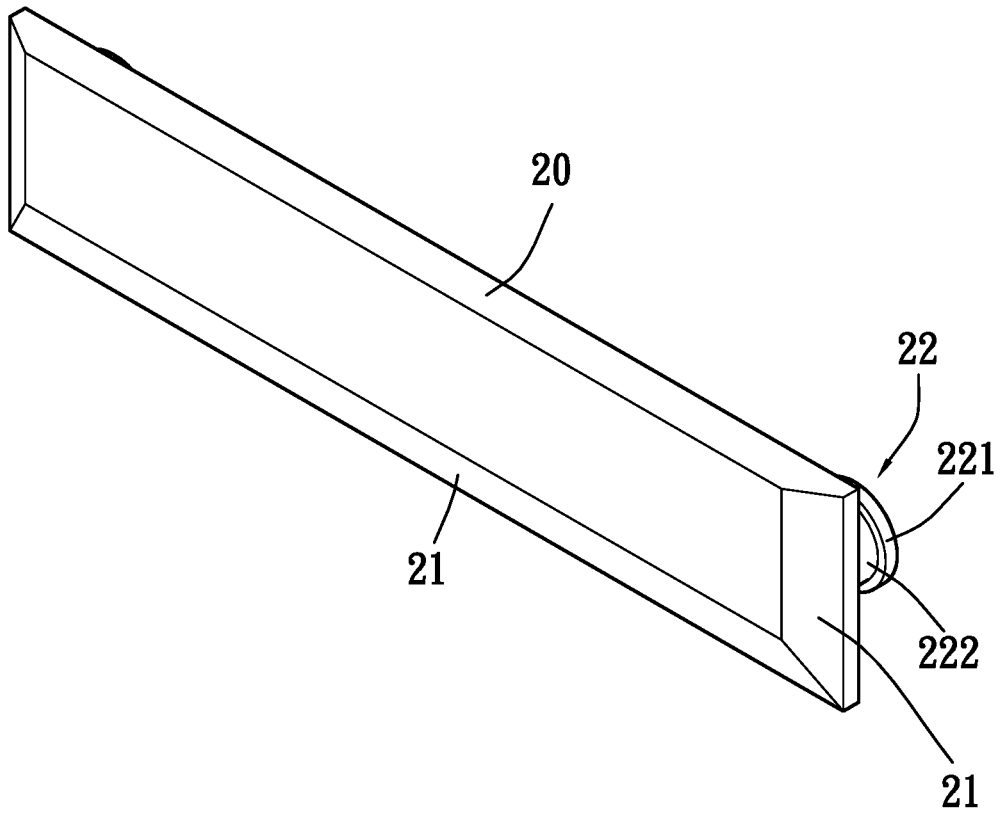
FIG. 4 is a schematic diagram of the front side of the cover plate of the present invention.

Besides, multiple bevels 21 are respectively set on left, right and below of the front side of the cover plate 20 (as shown in FIG. 4), the cover plate 20 is a long strip, two convexes 22 are set on the back side of the cover plate 20, wherein the two convexes 22 set on the back side of the cover plate 20 are respectively corresponded to the holes 13 set on two sides of the end of the signal terminal body 10, the convexes 22 are provided to be embedded into the holes 13, the convexes 20 of the cover plate 20 are cylinders 221, a disc 222 is set on the top of each cylinder 221 (as shown in FIG. 3), the periphery of the discs 222 is larger than the periphery of the cylinders 221, the discs 222 are conical, so that the discs 222 set on the top of the cylinders 221 are provided to be embedded into the holes 13 when the convexes 22 are embedded into the holes 13 set on the end of the signal terminal body 10 (as shown in FIG. 2), to prevent the cover plate 20 from being dropped out, and the back side of the cover plate 20 is provided to cover the core holes 11 set on the upper side of the end of the signal terminal body 10.

A concave 23 is set on the back side of the cover plate 20 (as shown in FIG. 2), the concave 23 is provided to place the wires 31 exposed from the core holes 11 to prevent the wires 31 from being compressed by the cover plate 20, wherein the concave 23 is any of a rectangular shape or a square shape, the concave 23 can be designed as different shapes according to the arrangement of the core holes 11, and the width of the cover plate 20 is smaller than the width of one end of the signal terminal body 10, therefore, when the wires 31 exposed from the core holes 11, the cover plate 20 is provided to form a barrier (as shown in FIG. 1), to prevent the wires 31 from being touched, to thereby avoid leakage or malfunction and achieve the purpose of protecting the signal terminal body 10.

The signal terminal body 10 is colored (not shown in figures), the color of the signal terminal body 10 could match the color of the network cable 30, different transmission rate can be recognized not only from the color of the network cable 30, the color of the signal terminal body 10 can also be provided to increase recognition, so that the transmission rate can be recognized from the signal terminal body 10.

From the above detailed description, for those skilled in the art, it will be apparent that the present invention can achieve the above mentioned objects, the present invention has already met the requirements of the Patent Law, and the inventor filed the patent application.

The above is only the preferred embodiments of the present invention, the scope of the present invention is not limited thereto; therefore, the simple equivalent changes and modifications made in accordance with the scope and the contents of the present invention should be within the scope of the present invention.

What is claimed is:

1. A network connector structure, comprising:

a signal terminal body, wherein the signal terminal body is hollow, multiple arranged slots are set on a lower side of an end of the signal terminal body, multiple arranged core holes are set on an upper side of the end of the signal terminal body, and two holes are set respectively on two sides of the end of the signal terminal body; and a cover plate, wherein the cover plate comprises an elongated strip body, two convexes are set on a back side of the cover plate, the convexes set on the back side of the cover plate respectively corresponding to the holes set on two sides of the end of the signal terminal body such that the convexes are provided to be embedded into the holes, the core holes set on the upper side on the end of the signal terminal body are provided to be covered by the back side of the cover plate, multiple bevels are set left, right, and below a front side of the cover plate, the convexes are cylinders, a disc is set on the top of each of the cylinders, a periphery of the disc on the top of each of the cylinders is larger than a periphery of the cylinders, and the disc set on the top of each of the cylinders is conical.

2. The network connector structure as claimed in claim 1, wherein a concave is further set on the back side of the cover plate.

3. The network connector structure as claimed in claim 2, wherein the concave has a rectangular shape or a square shape.

4. The network connector structure as claimed in claim 1, wherein a width of the cover plate is smaller than a width of the end of the signal terminal body.

5. The network connector structure as claimed in claim 1, wherein a metal piece is further set in the slots of the signal terminal body.

6. The network connector structure as claimed in claim 4, wherein multiple tips are further set on an end of the metal piece.

7. The network connector structure as claimed in claim 1, wherein the signal terminal body is further colored.

8. A method, comprising:

providing a network connector structure, the network connector structure comprising:

a signal terminal body, wherein the signal terminal body is hollow, multiple arranged slots are set on a lower side of an end of the signal terminal body, multiple arranged core holes are set on an upper side of the end of the signal terminal body, and two holes are set respectively on two sides of the end of the signal terminal body; and a cover plate, wherein the cover plate comprises an elongated strip body, two convexes are set on a back side of the cover plate, the convexes set on the back side of the cover plate respectively corresponding to the holes set on two sides of the end of the signal terminal body such that the convexes are provided to be embedded into the holes, the core holes set on the upper side on the end of the signal terminal body are provided to be covered by the back side of the cover plate, multiple bevels are set left, right, and below a front side of the cover plate, the convexes are cylinders, a disc is set on the top of each of the cylinders, a periphery of the disc on the top of each of the cylinders is larger than a periphery of the cylinders, and the disc set on the top of each of the cylinders is conical.

* * * * *